US006894430B2

(12) United States Patent
Lee

(10) Patent No.: US 6,894,430 B2
(45) Date of Patent: May 17, 2005

(54) COLOR CATHODE-RAY TUBE

(75) Inventor: Seok Moon Lee, Gumi-si (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 10/328,016

(22) Filed: Dec. 26, 2002

(65) Prior Publication Data

US 2003/0227246 A1 Dec. 11, 2003

(30) Foreign Application Priority Data

Jun. 7, 2002 (KR) ..... 2002-31941

(51) Int. Cl.[7] ..... H01J 29/70
(52) U.S. Cl. ..... 313/440; 313/421
(58) Field of Search ..... 313/440, 413, 313/431, 433, 421, 426; 335/213, 214

(56) References Cited

U.S. PATENT DOCUMENTS

| | | | | | |
|---|---|---|---|---|---|
| 3,192,432 | A | * | 6/1965 | Nero | 315/399 |
| 3,806,750 | A | * | 4/1974 | Tsuneta et al. | 313/364 |
| 4,229,720 | A | * | 10/1980 | Heijnemans et al. | 335/213 |
| 5,757,120 | A | * | 5/1998 | Honda et al. | 313/437 |
| 5,763,995 | A | | 6/1998 | Sano et al. | |
| 6,208,068 | B1 | | 3/2001 | Lee et al. | |
| 6,617,780 | B2 | * | 9/2003 | Cho et al. | 313/440 |
| 6,686,709 | B2 | * | 2/2004 | Lee et al. | 315/370 |
| 2002/0008458 | A1 | * | 1/2002 | Akoh et al. | 313/440 |
| 2002/0027409 | A1 | * | 3/2002 | Kojima | 313/440 |
| 2002/0140337 | A1 | | 10/2002 | Kim et al. | |
| 2003/0222566 | A1 | * | 12/2003 | Ogawa et al. | 313/440 |

FOREIGN PATENT DOCUMENTS

| | | |
|---|---|---|
| JP | 48-34349 | 5/1973 |
| JP | 56-063757 | 5/1981 |
| JP | 08-007792 | 1/1996 |

* cited by examiner

*Primary Examiner*—Glenn Zimmerman
(74) *Attorney, Agent, or Firm*—Birch, Stewart, Kolasch & Birch, LLP

(57) ABSTRACT

A rectangular-shaped deflection yoke, RTC (Round Core Tetra Coil Combined Deflection Yoke) enhances deflection sensitivity of a cathode-ray tube. More specifically, a deflection yoke structure for a cathode-ray tube is mounted with rectangular shaped deflection coils and circular shaped ferrite cores, and the difference between a maximum gap and a minimum gap for the deflection coil and the ferrite core is greatest at an end section on a screen side of the ferrite core.

19 Claims, 24 Drawing Sheets

COLOR CATHODE-RAY TUBE

BACKGROUND OF THE INVENTION

1. Field of the Invention

The present invention relates to a rectangular-shaped deflection yoke, RTC (Round Core Tetra Coil Combined Deflection Yoke) for enhancing deflection sensitivity of a color cathode-ray tube. More specifically, the present invention relates to a deflection yoke structure for a color cathode-ray tube that is mounted with rectangular shaped deflection coils and a circular shaped ferrite core, and a gap therebetween is not uniform. Rather, the difference between a maximum gap and a minimum gap is greatest at an end section on a screen side of the ferrite core.

2. Background of the Related Art

As depicted in FIG. 1, a color cathode-ray tube includes a panel 1 mounted in a front surface of the cathode-ray tube, a fluorescent screen 3 placed on an inner surface of the panel 1, three primary colors (chrominance signals), namely R, G, and B, are being applied to the screen, a shadow mask 2 for selecting a color incidented on the fluorescent screen 3, a funnel 6 coupled to a rear surface of the panel 1 for maintaining the inside of the tube in a vacuum state, electron guns 5 mounted inside of a tube-shaped neck portion on the rear side of the funnel 6 for emitting electron beams, and a deflection yoke 4 that surrounds an outside of the funnel 6 and deflects the electron beams in the horizontal and vertical directions.

A generally known color cathode-ray tube uses a three-beam in-line type electron gun. In such a cathode-ray tube, R, G, and B electron beams are arranged in parallel, and a self-converging principle using non-homogenous (non-uniform) magnetic fields is applied thereto for converging those three electron beams on one point of the fluorescent screen 3.

Particularly, the deflection yoke 4, as illustrated in FIGS. 2*a* and 2*b*, includes a pair of horizontal deflection coils 41 for deflecting electron beams emitted from the electron guns 5 in the horizontal direction, a pair of vertical deflection coils for deflecting electron beams emitted from the electron guns 5 in the vertical direction, a ferrite core 44 for enhancing a magnetic efficiency by minimizing a loss in a magnetic force generated by the horizontal and vertical deflection coils, a holder 43 for fixing the horizontal and vertical deflection coils and the ferrite core at predetermined positions and insulating the horizontal and vertical deflection coils, a COMA free coil 45 mounted in a neck portion of the holder 43 for improving comma aberration caused by a vertical barrel type magnetic field, a ring band 46 mounted in an end of the neck portion of the holder 43 for mechanically coupling the cathode-ray tube with the deflection yoke 4, and a magnet 47 mounted in an end of an aperture side of the deflection yoke 4 for correcting raster distortion (hereinafter, it is referred to as distortion).

Thusly constituted deflection yoke 4 can be divided into several kinds, as shown in Table 1, in accordance with a sectional configuration of an end portion of the screen side of the horizontal, vertical deflection coils 41,42 and the ferrite core 44.

That is, as depicted in FIGS. 4 and 5, if the horizontal and vertical deflection coils 41, 42 have a circular shape, the sectional configuration of the end portion of the screen side of the ferrite core 44 is also circular. Similarly, if the horizontal and vertical deflection coils 41, 42 have a rectangular shape, the sectional configuration of the end portion of the screen side of the ferrite core 44 is also rectangular.

TABLE 1

| Deflection yoke | Horizontal deflection coil | Vertical deflection coil | Ferrite core |
|---|---|---|---|
| Circular deflection yoke | Circular coil | Circular coil | Circular core |
| RAC deflection yoke | Rectangular coil | Rectangular coil | Rectangular core |

Especially, the RAC deflection yoke 4 has a more improved deflection sensitivity than the circular deflection yoke 4 because the sectional configuration of the end portion of the screen side for the horizontal and vertical deflection coils 41, 42 and the ferrite core 44 in the RAC deflection yoke 4 is a rectangular shape, respectively, and thus can shorten the distance between electron beams.

In general, the conventional deflection yoke 4 allows a current having a frequency of 15.75 KHz or above to travel in the horizontal deflection coil 41, and using the magnetic field generated around the coil, deflects electron beams inside of the cathode ray tube in the horizontal direction. Also, the conventional deflection yoke 4 allows a current having a frequency of 60 Hz to travel in the vertical deflection coil 42, and using the magnetic field generated around the coil, deflects electron beams inside of the cathode ray tube in the vertical direction.

One of recently developed deflection yokes is a self-convergence type deflection yoke 4, which uses the non-uniform magnetic fields around the horizontal and vertical deflection coils 41, 42 in order to converge three electron beams on a screen, without using a separate additional circuit or device.

In other words, by adjusting the winding distribution of the horizontal and vertical deflection coils 41, 42, the self-convergence type deflection yoke 4 creates a barrel or pin-cushion shaped magnetic field for each section (i.e., aperture section, middle section, neck section), and allows three electron beams to experience a different deflecting force from one another depending on their positions, yet to converge upon one point from different distances although each electron beam starts and ends in different positions from one another.

Meanwhile, when an attempt was made to generate a magnetic field by providing a current to the deflection coil, it was discovered that it was not an easy task to deflect electron beams to the entire surface of the screen using only the magnetic field generated by the coil. To avoid such difficulties, many now use the ferrite core 44 having a high permeability, hoping to minimize any loss in the magnetic field on its way of return and consequently to enhance the magnetic efficiency and magnetic force.

Referring to FIG. 7, each of the pair of horizontal deflection coil consists of a rectangular-shaped upper horizontal deflection coil and a rectangular-shaped lower horizontal deflection coil. The pin-cushion shaped horizontal deflection magnetic field is created by connecting the upper and lower horizontal deflection coils in parallel as illustrated in FIG. 3*a*, and allowing a saw-tooth shaped horizontally deflecting current to travel in the coils (see FIG. 3*b*).

The deflection yoke with the constitution described above can be largely divided into two groups.

One of them is associated with the circular deflection yoke 4 where the horizontal and vertical deflection coils 41, 42 have a circular shape, and the sectional configuration of the end portion of the screen side is also circular as shown in FIGS. 4 and 5. In such case, the area ratio of an aperture section of the neck side of the deflection coil to an aperture section on the screen side of the deflection coil is not smaller than 10 to 1, meaning that the center of the deflection slants toward the neck side.

In reality, though, the position of the deflection yoke mounted in the cathode ray tube should be designed in such a manner that it inclines to the screen side, not the neck side, in order to reserve a little allowance against BSN (Beam Strike Neck) phenomenon, namely electron beams emitted from the electron guns strike the inner surface of the funnel. This unfortunately weakens the deflection sensitivity a great deal.

The other is associated with the RAC type deflection yoke 4 where the configuration of the horizontal and vertical deflection coils 41, 42 and the ferrite core 44 are all rectangular. As depicted in FIGS. 6 and 7, three electron beams emitted from the electron guns 5, namely red, green, and blue beams, pass through the horizontally deflected magnetic field, and according to the Fleming's left hand rule the electron beams are deflected in the horizontal direction, being inversely proportional to the cube of the distance between the inner surface of the horizontal deflection coil and the electron beams.

Therefore, if the horizontal and vertical deflection coils 41, 42 have a rectangular shape, the distance between the electron beams and the deflection coil becomes shorter by 20% and the horizontal and vertical deflection sensitivities can be improved up to approximately 20~30%.

To summarize, the conventional deflection yoke 4 for use in cathode ray tube has the following shortcomings.

First, in case of the circular deflection yoke, its circular shaped deflection coil creates an unnecessary distance between the electron beams and the deflection coil as illustrated, and as the result thereof, the deflection sensitivity is worse. In FIG. 10, $\Delta V$ is a vertical distance between the electron beams and the deflection coil and $\Delta H$ is a horizontal distance between the electron beams and the deflection coil. This problem becomes more serious for an wide angle deflection yoke. Hence, it seems almost impossible to develop a high-resolution, high frequency deflection yoke at this point.

Second, a percentage of contraction of the ferrite core 44 mounted in RAC deflection yoke reaches 20%, and the process tolerance due to limitations existing in a manufacturing process is ±2%. In addition, in case of the conventional ferrite core 44, of which inner surface has a rectangular shape (despite the original purpose of using the rectangular shaped inner surface, such as, enhancing the deflection sensitivity) it gives rise to different diameters for the inner surfaces on the upper and lower sides. In consequence, the process tolerance of the manufacturing process was three times (in maximum) greater than that of the conventional circular core, and the production yield of ferrite cores was at most 50% of the conventional circular cores. In fact, since the shape of the inner surface of the rectangular ferrite core is also rectangular, conducting an abrasive blasting process more effectively during the manufacturing process and therefore maintaining precise size can be very difficult. This small quantity, 50% (at best), of rectangular cores only increased the unit price of the core up to 200% of the conventional circular core.

SUMMARY OF THE INVENTION

An object of the invention is to solve at least the above problems and/or disadvantages and to provide at least the advantages described hereinafter.

Accordingly, one object of the present invention is to solve the foregoing problems by providing a deflection yoke structure for the cathode-ray tube with enhanced deflection sensitivity by using a RTC deflection yoke which cross-section has a rectangular shape, the RTC deflection yoke including a rectangular shaped deflection coil and a circular shaped ferrite core, wherein a difference between a maximum gap and a minimum gap among other gaps between the deflection coil and the ferrite core is greatest at an end portion of the screen side of the ferrite core.

Another object of the present invention to provide a deflection yoke for the cathode-ray tube capable of reducing size distribution of an inner surface thereof and easing an abrasive blasting process for thereby making a remarkable improvement in yield and size distribution of ferrite cores.

The foregoing and other objects and advantages are realized by providing a color cathode ray tube comprising a panel having a fluorescent screen on which Red, Green, and Blue fluorescent substances are applied, a funnel coupled to a rear surface of the panel for maintaining an inside thereof in a vacuum state, an electron gun installed inside of a pipe-shaped neck section disposed at a rear side of the funnel for emitting electron beams, and a deflection yoke for horizontally or vertically deflecting the electron beams, wherein the deflection yoke comprises a horizontal deflection coil and a vertical deflection coil for deflecting electron beams emitted from the electron gun in the horizontal or vertical direction, a holder for fixing the horizontal and vertical deflection coils and the ferrite core at predetermined positions and insulating the horizontal and vertical deflection coils and a ferrite core for enhancing a magnetic efficiency by minimizing a loss in a magnetic force generated by the horizontal and vertical deflection coils. Preferably, the sectional configuration of the screen side of the horizontal or vertical deflection coils is rectangular in shape, and the shape of the ferrite core is either circular or elliptical. Also, an outer surface size (HS) of a flange section on the screen side of the horizontal deflection coil mounted inside of the ferrite core is in a range of from 80% to 110% of an inner face actual size (FS) of an end section on the screen side of the ferrite core.

According to another aspect of the invention, a color cathode ray tube comprises a panel having a fluorescent screen on which Red, Green, and Blue fluorescent substances are applied, a funnel coupled to a rear surface of the panel for maintaining an inside thereof in a vacuum state, an electron gun installed inside of a pipe-shaped neck section disposed at a rear side of the funnel for emitting electron beams, and a deflection yoke for horizontally or vertically deflection the electron beams, wherein the deflection yoke comprises a horizontal deflection coil and a vertical deflection coil for deflecting electron beams emitted from the electron guns in the horizontal or vertical direction, a ferrite core for enhancing a magnetic efficiency by minimizing a loss in a magnetic force generated by the horizontal and vertical deflection coils, and a holder for fixing the horizontal and vertical deflection coils and the ferrite core at predetermined positions and insulating the horizontal and vertical deflection coils. Preferably, the sectional configuration of the screen side of the horizontal or vertical deflection coils has a rectangular shape, and that of the ferrite core is either circular or elliptical.

According to the embodiment described above, the sectional configuration of the neck side of the horizontal or vertical deflection coils is either circular or elliptical.

Preferably, the sectional configurations of the screen side and the neck side of the ferrite core are all circular or elliptical.

According to the embodiment described above, the deflection yoke can exist even when few minimum and maximum gaps exist between the ferrite core and its corresponding deflection coil, on the basis of a plane perpendicular to a tube axis.

Preferably, the difference between the maximum gap and the minimum gap is greatest at the end portion of the screen side.

More preferably, the minimum gap ranges from 0 mm to 1.0 mm, and the maximum gap ranges from 1 mm to 30 mm.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a deflection yoke structure for the cathode-ray tube according to a preferred embodiment of the invention in reference to the accompanying drawings.

Figure 1:
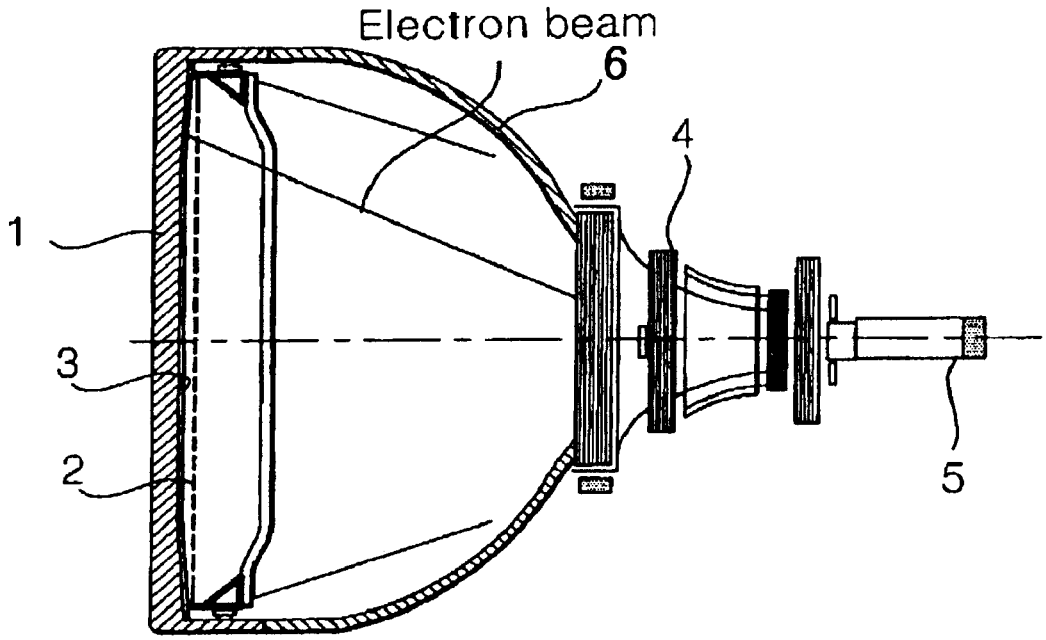
FIG. 1 (Related Art)
FIG. 1 is a schematic diagram of a cathode-ray tube and a deflection yoke from a related art.
Figure 2A:
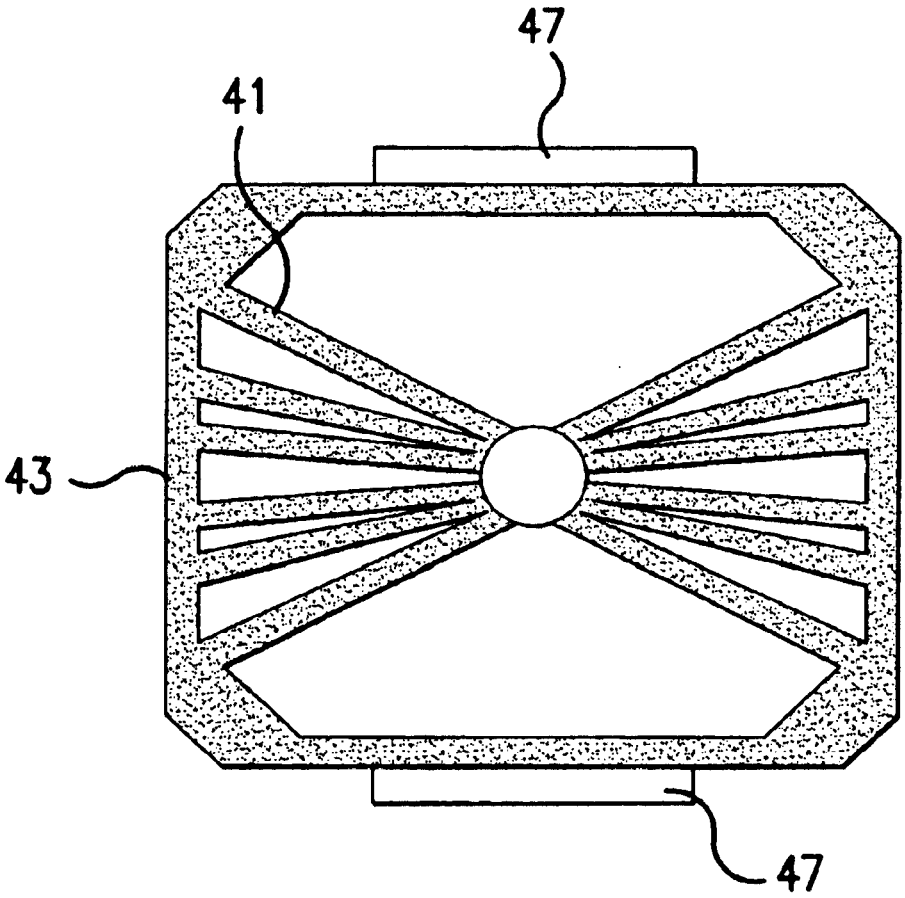
FIG.2a RELATED ART
FIGS. 2*a* and 2*b* are schematic diagrams of a deflection yoke from a related art.
Figure 2B:
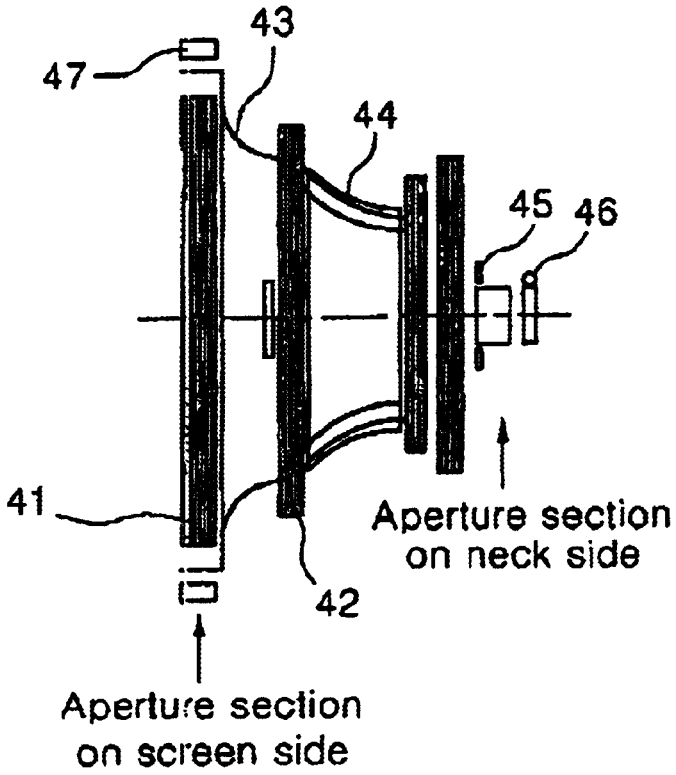
FIG. 2b (Related Art)
Figure 3A:
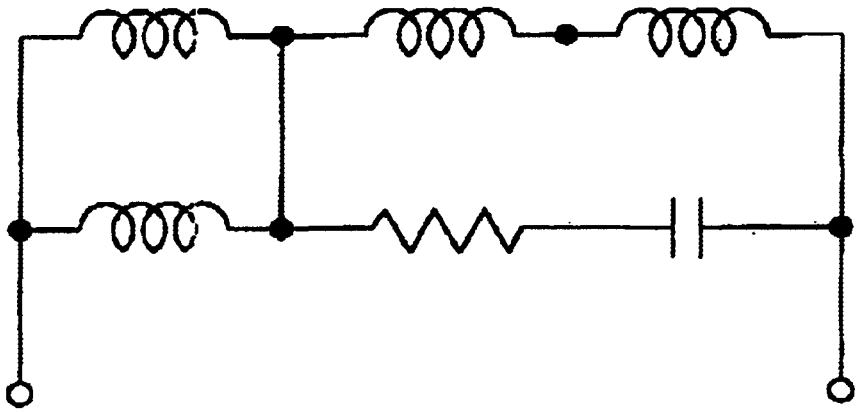
FIG. 3a (Related Art)
FIGS. 3*a* and 3*b*, respectively, illustrates a horizontally deflected circuit and a horizontally deflecting current applied to the deflection yoke of the related art.
Figure 3B:
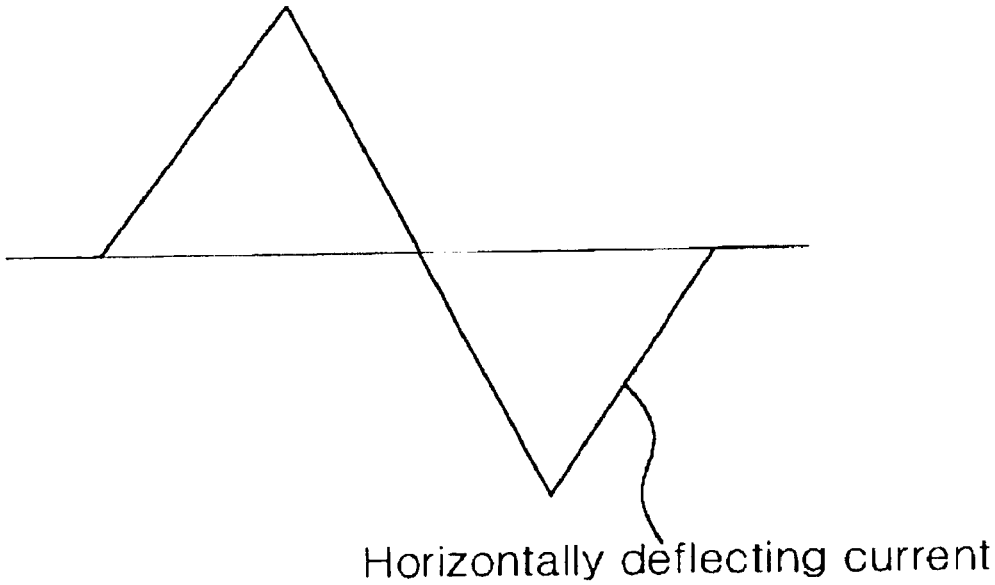
FIG. 3b (Related Art)
Figure 4:
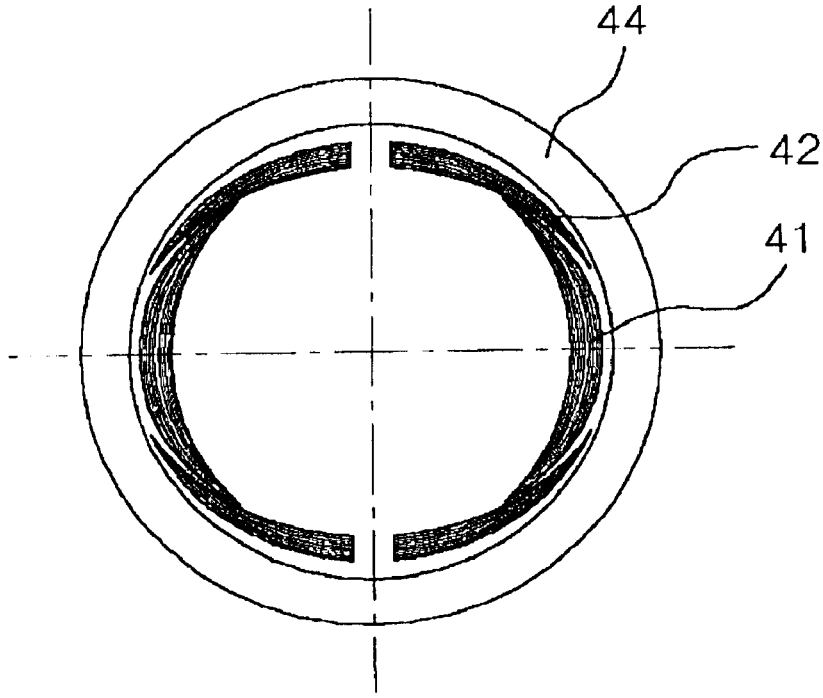
FIG. 4 (Related Art)
FIG. 4 is a cross-sectional view illustrating a circular deflection yoke from a related art.
Figure 5:
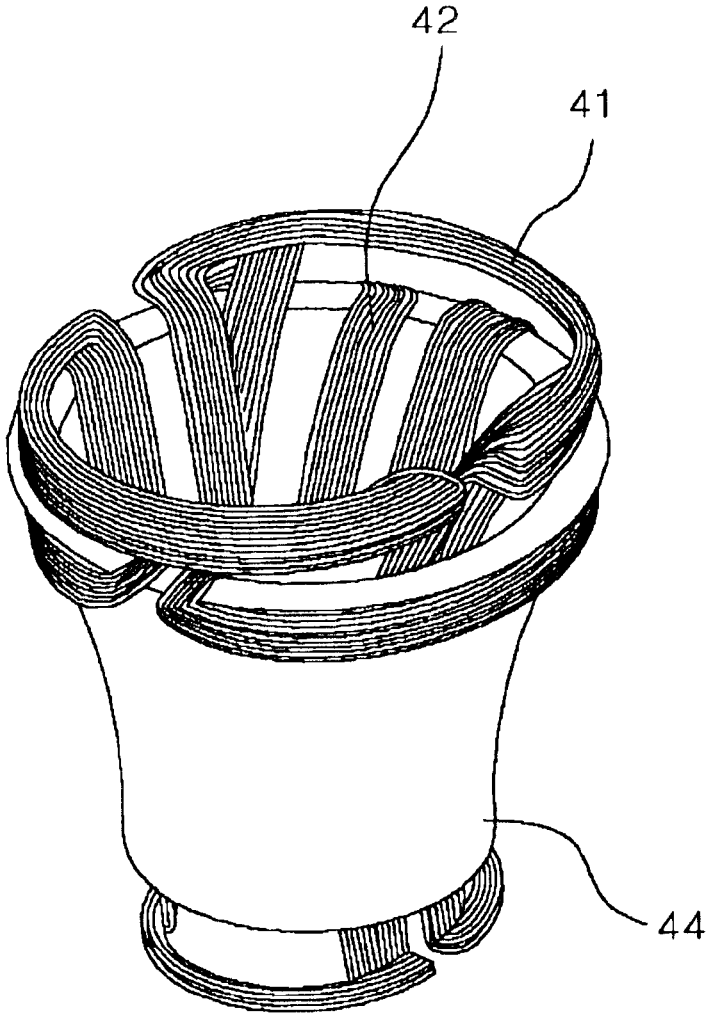
FIG. 5 (Related Art)
FIG. 5 is a perspective view illustrating the circular deflection yoke from a related art.
Figure 6:
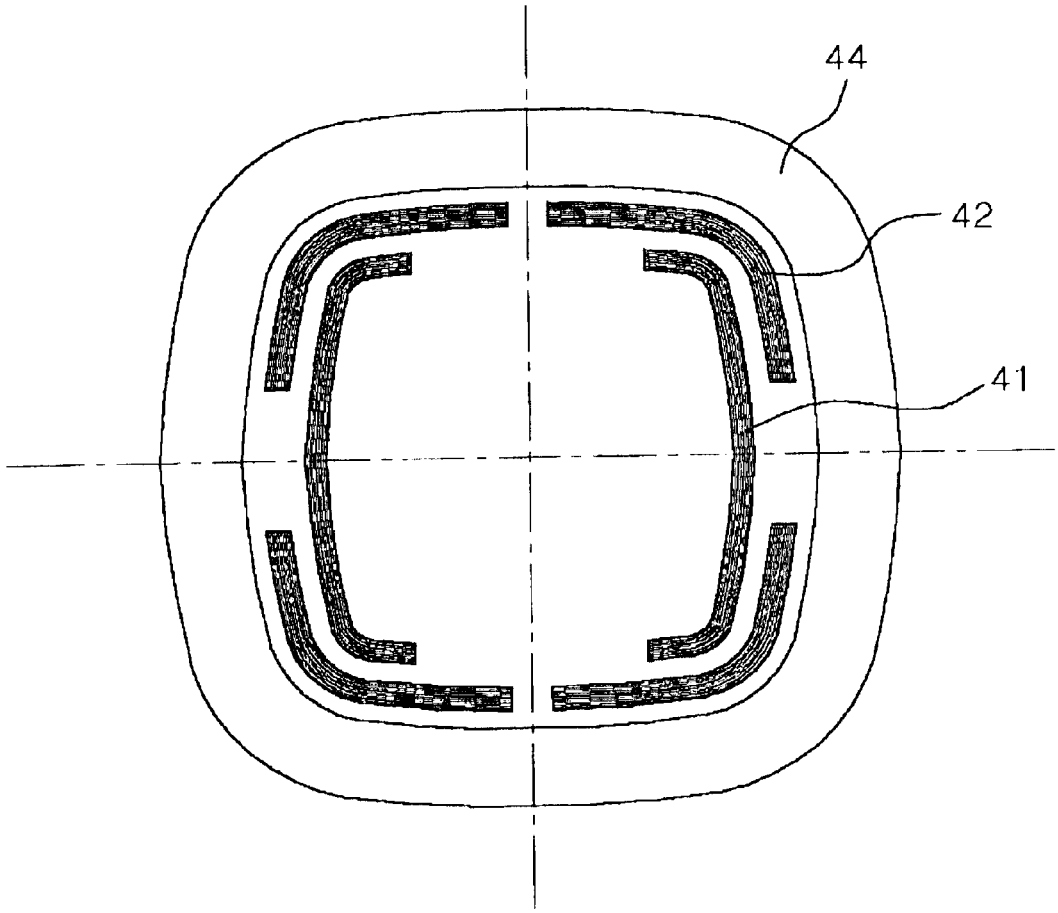
FIG. 6 (Related Art)
FIG. 6 is a cross-sectional view illustrating a RAC deflection yoke from a related art.
Figure 7:
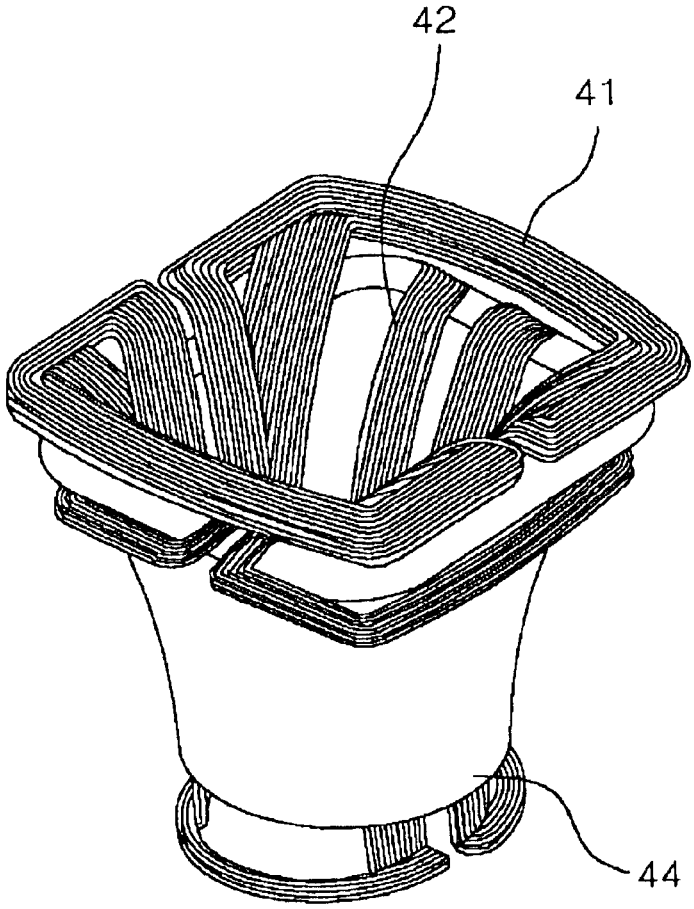
FIG. 7 (Related Art)
FIG. 7 is a perspective view illustrating the RAC deflection yoke from the related art.
Figure 8:
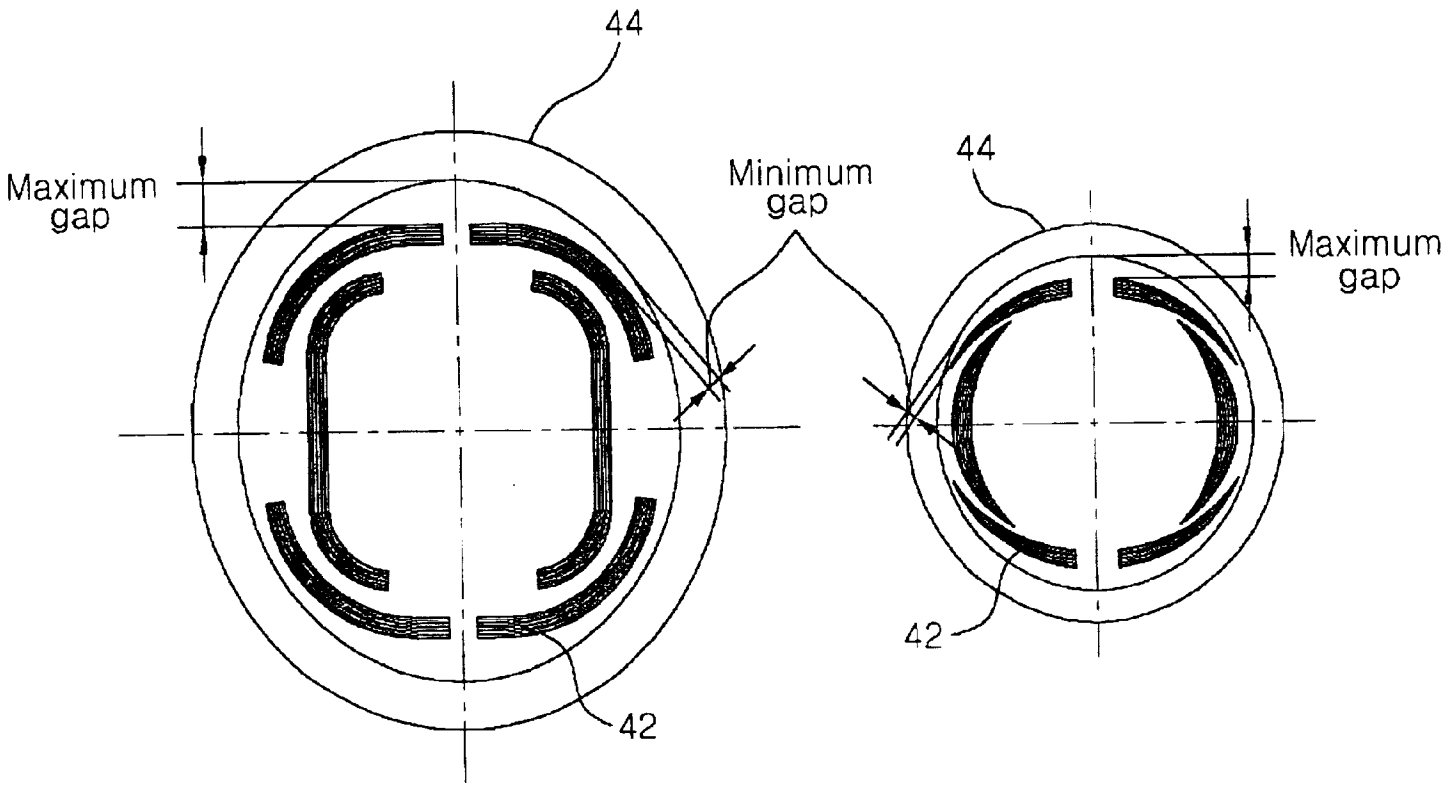
FIG. 8 is a cross-sectional view illustrating a RTC deflection yoke according to a preferred embodiment of the present invention.
Figure 9:
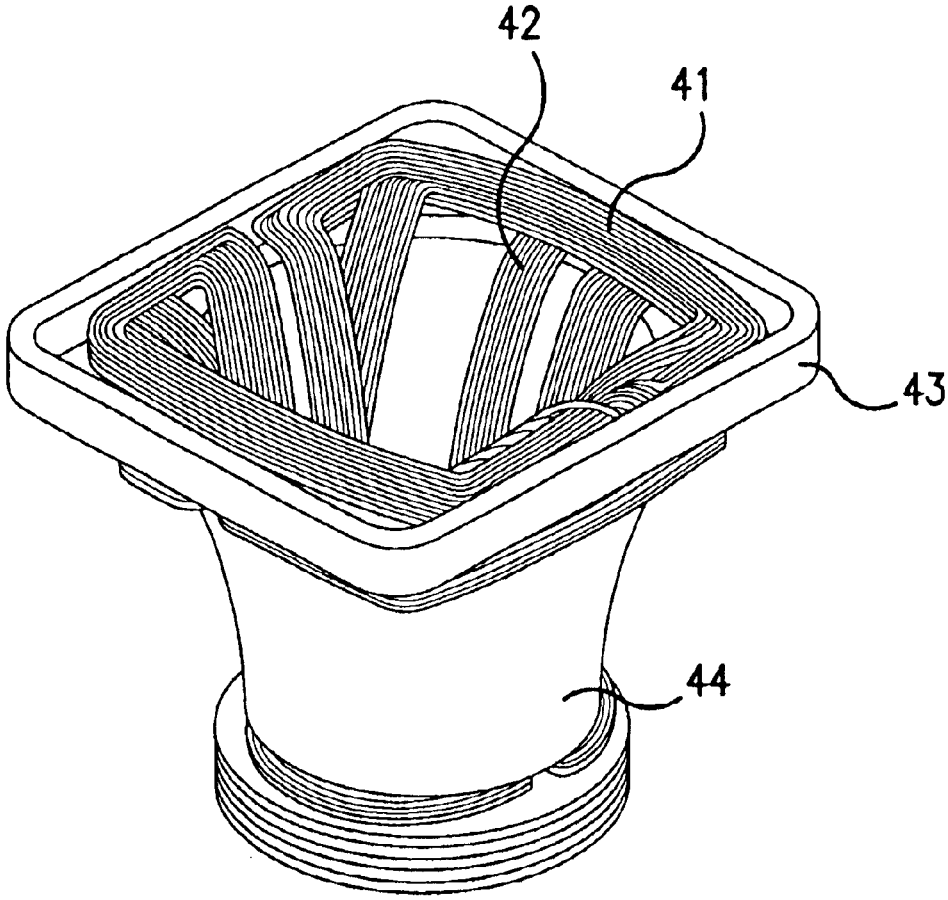
FIG. 9 is a perspective view illustrating the RTC deflection yoke according to the preferred embodiment of the present invention.
Figure 10:
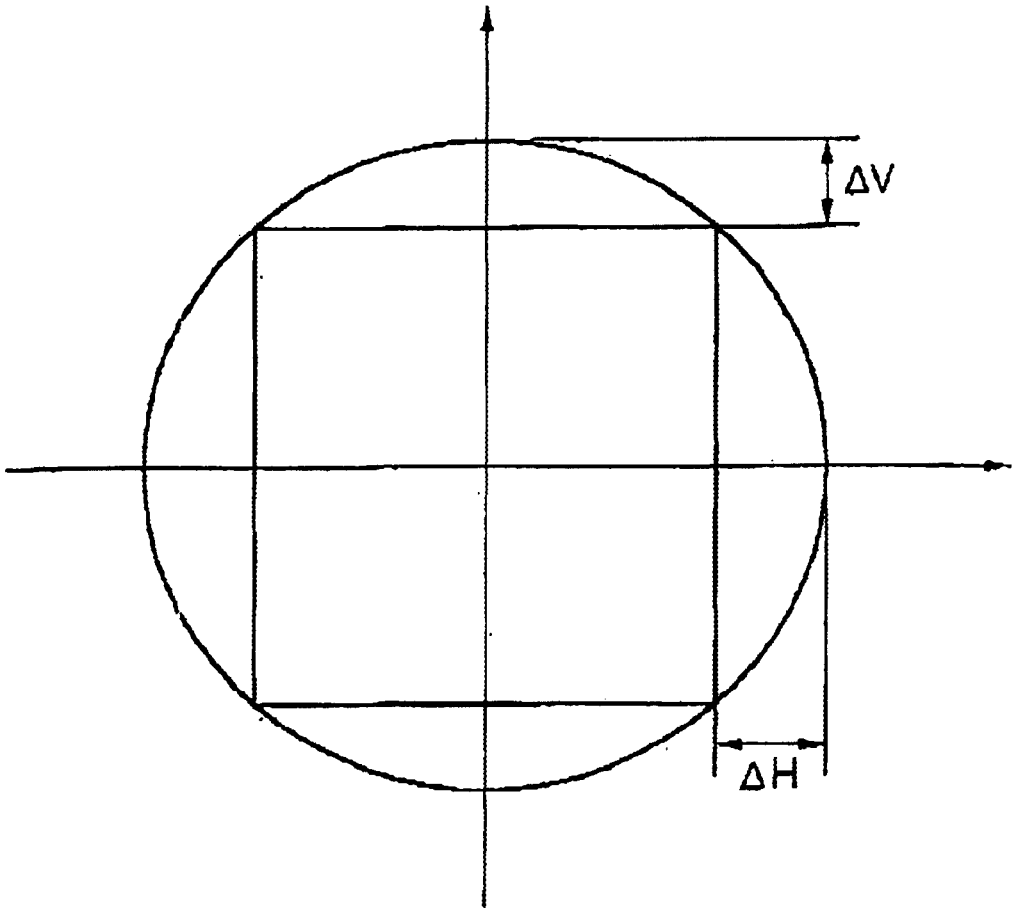
FIG. 10 (Related Art)
FIG. 10 is a cross-sectional view of a funnel section of the cathode ray tube.
Figure 11A:
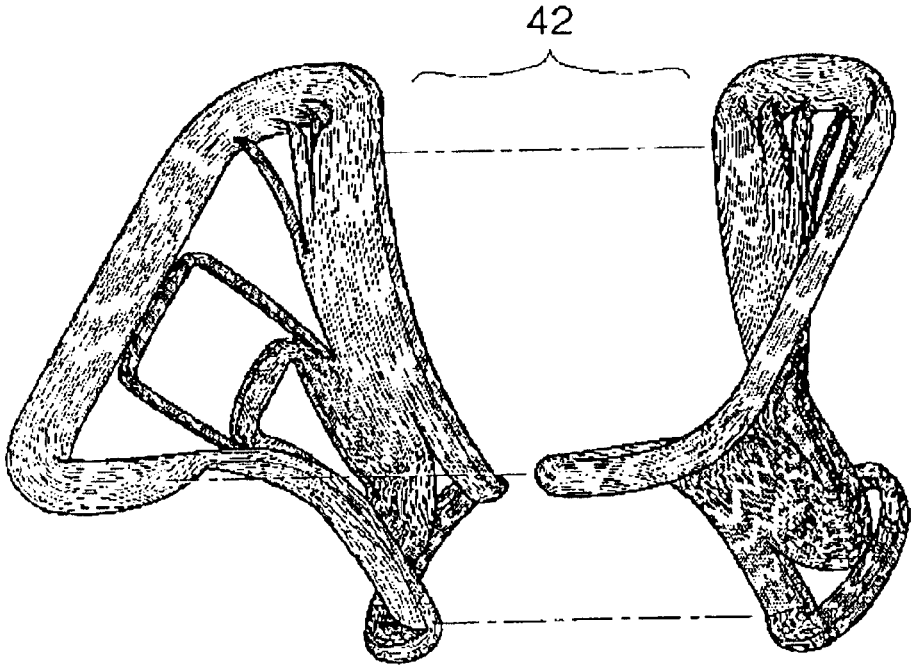
FIGS. 11*a* and 11*b*, respectively, represents before and after a vertical deflection coil is assembled.
Figure 11B:
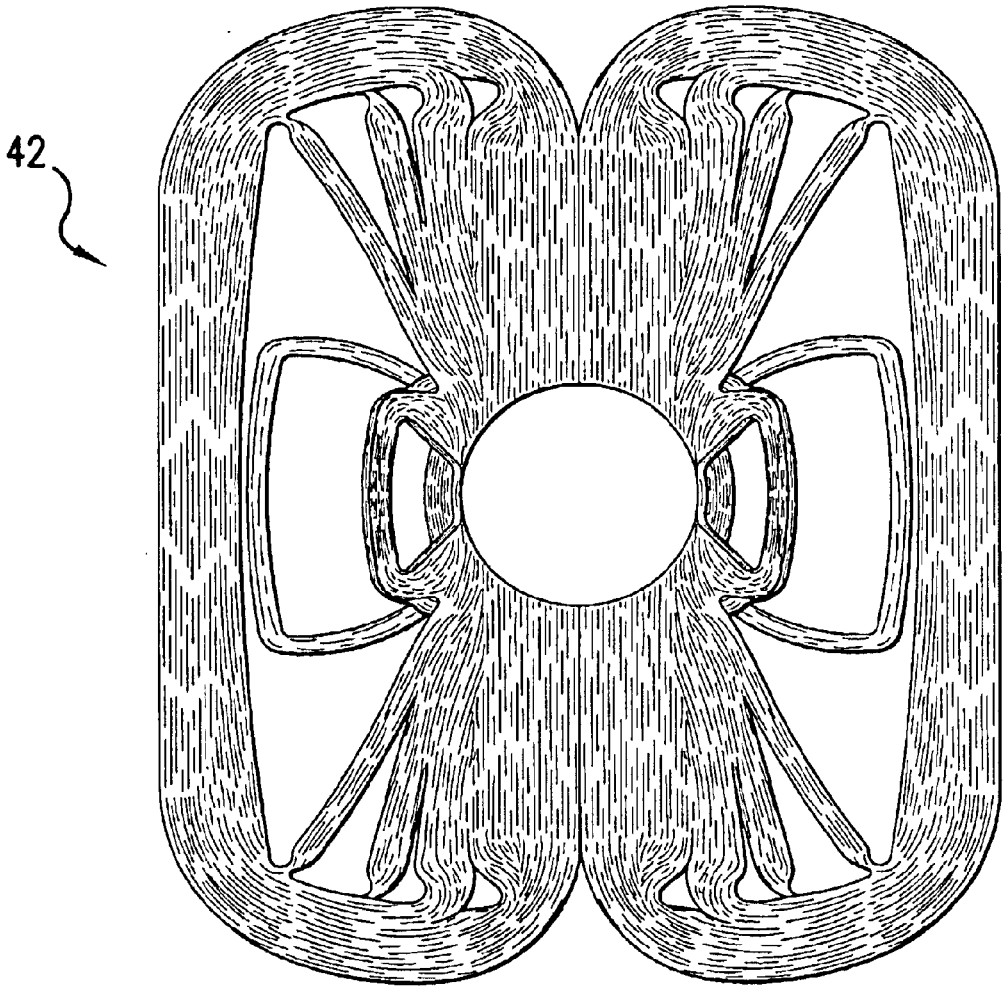
Figure 12:
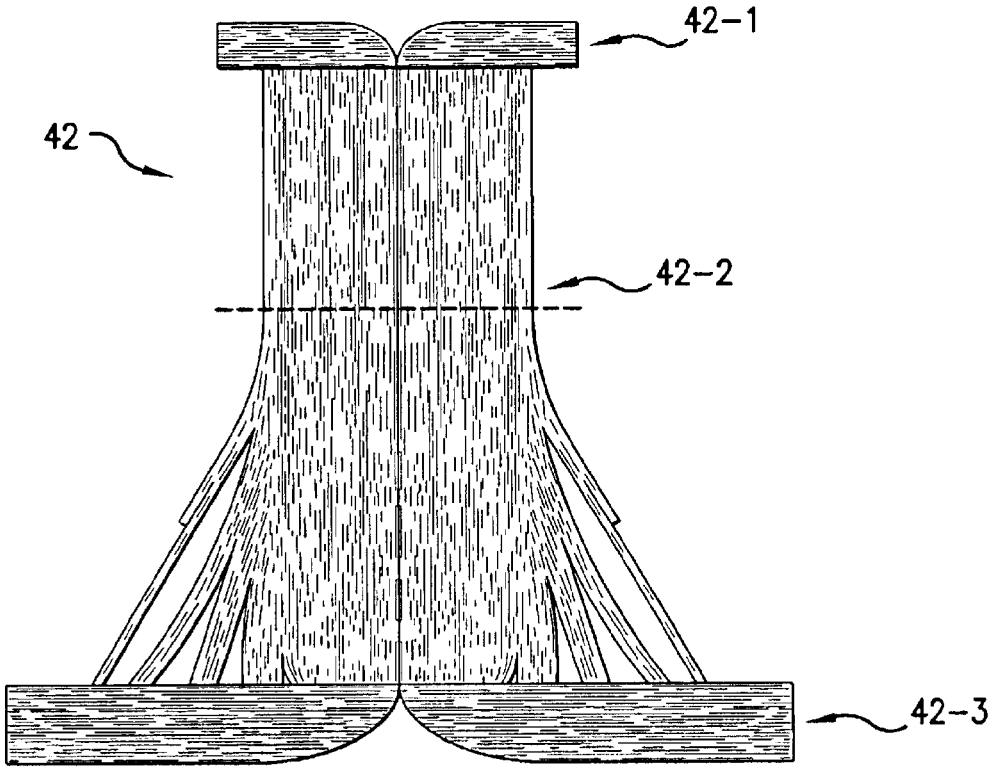
FIG. 12 is an assembly diagram of the vertical deflection coil of the present invention.

As depicted in FIGS. 8 and 9, the sectional configuration on the screen sides of the horizontal and vertical deflection coils 41, 42 of the deflection yoke 4 embodying the principles of the present invention, RTC (Round Core Tetra Coil Combined) deflection yoke are in a substantially rectangular shape.

In addition, the sectional configuration on the screen side of the holder in the RTC deflection yoke is in a rectangular shape. The ferrite core 44 as shown in FIGS. 8, 9, 12, and 13 is designed in such a manner that there is a maximum gap and a minimum gap between the inner surface on the screen side of the ferrite core and the deflection coil on opposite side.

The difference between the two gaps is greatest at the screen side end section of the ferrite core 44. This is good for improving convergence and distortion errors caused by the size deviation on the inner surface of the rectangular shaped ferrite core 44. Further, the cost of materials for ferrite cores 44 can be reduced, and the deflection sensitivity can be greatly enhanced.

Similarly, according to the structure of the RTC deflection yoke shown in FIGS. 8, 9, 11*a*, 11*b*, 12, and 13, the screen sides of the horizontal and vertical deflection coils 41, 42 are in a rectangular shape, thereby improving the size deviation of the inner surface of the ferrite core 44 and the deflection sensitivity, and the size of the rectangular shape of the sectional end on the screen side of the ferrite core 44 is not large because it will only give rise to a severe size deviation as in the related art, but the deflection yoke is structured in a particular way so that the gap between the inner surface of the ferrite core and its opposite vertical deflection coil 42 is sometimes largest or smallest on the basis of the plane perpendicular to the tube axis.

In fact, the difference between the maximum gap and the minimum gap is greatest at the end section on the screen side of the ferrite core 44.

The ferrite core 44, as shown in FIG. 8, has a structure in which, the minimum gap is almost homogeneous within a range 0~1 mm at the end section on the screen side of the deflection coil, having used the perpendicular plane to the tube axis as the basis, while the maximum gap between the vertical deflection coil 42 and the inner surface of the ferrite core 44 is in range of 1 mm~30 mm.

Figure 13:
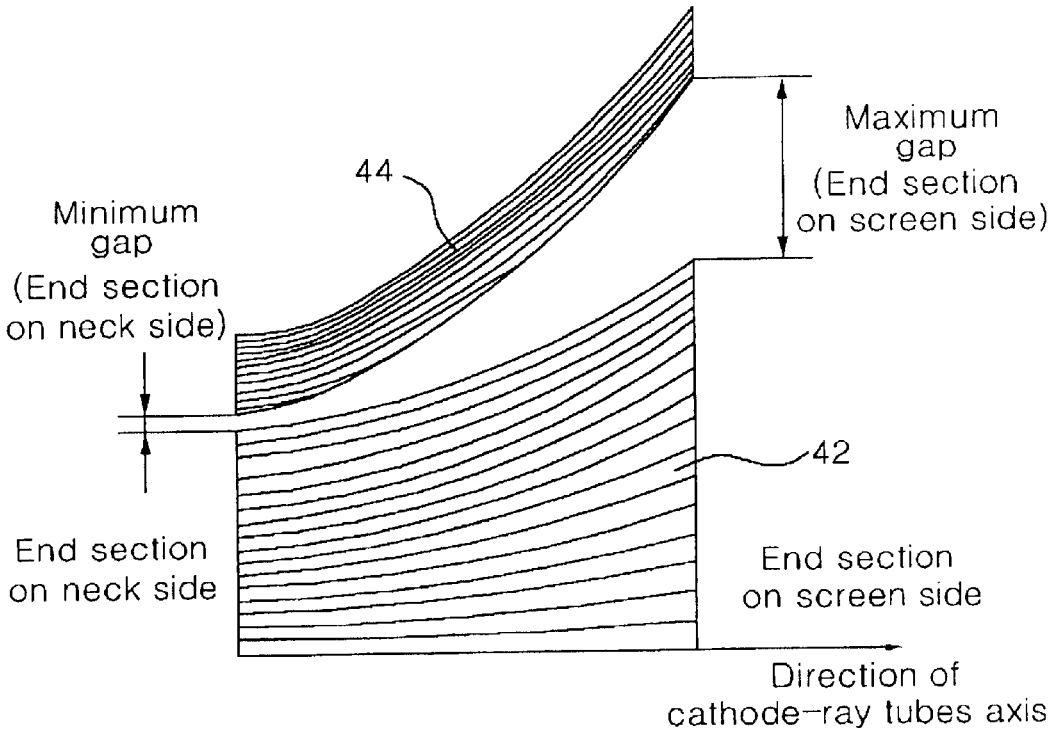
FIG. 13 is an assembly diagram of the vertical deflection coil and a ferrite core of the present invention.

Also as depicted in FIG. 13, the increase rate of the maximum gap toward the tube axis of the cathode-ray tube, given that the neck side of the ferrite core 44 was used as the basis, ranges from 0% to 6000% to the most, and the rate gradually increased from the neck side to the screen side end section of the ferrite core 44.

Thusly structured RTC deflection yoke is distinctive from the other known circular deflection yokes and RAC deflection yoke in the related art in many aspects.

To begin with, comparing the circular deflection yoke with the RAC deflection yoke, one realizes that the deflection sensitivity of the deflection yoke is inversely proportional to the cubic of the distance between the deflection coil and the electron beam. Also, the rectangular deflection coil, unlike the circular deflection coil, has shortened the distance between the deflection coil and the electron beam by 20%, and this consequently improved the deflection sensitivity by 20–30%.

However, the conventional RAC deflection yoke exposed several shortcomings. For example, since the cross-section of the deflection coil and the ferrite core were all in a rectangular shape, the inner surface of the ferrite core naturally had different lengths. This size deviation eventually caused a mis-convergence and distortion error, and an increase in cost. Hence, many had a very difficult time producing this type of deflection yoke.

On the other hand, the RTC deflection yoke of the present invention is different from the conventional circular deflection yoke in terms of the center of the deflection of the horizontal deflection coil.

That is, the inner surface areas of aperture sections on the neck side for both deflection yokes are similar to each other. However, in case of the circular deflection yoke's aperture section on the neck side is and its aperture section from the middle part to the screen side, each section being non-circular, the inner surface area of the aperture section is at least 10 times greater than the inner surface area of the aperture section on the neck side. On the other hand, the inner surface area of the aperture section in the RTC deflection yoke is at least four times greater than that of the neck side. This means that the center of the deflection for the horizontal deflection coil for the RTC deflection coil, unlike the circular deflection coil, is much closer to the screen side.

When the center of deflection translates toward the screen side, more space is created, e.g., several millimeters broader than the conventional deflection yoke, no matter how often the electron beams emitted from the electron gun might strike the inner surface of the funnel. This phenomenon is called BSN (Beam Strike Neck), and the horizontal deflection coil is shifted closer to the neck side by 1–10 mm.

The same result is obtained from the vertical deflection coil.

If the horizontal and vertical deflection coils translate toward the neck side, the ferrite core should translate to the neck side also. The following explains some of advantages of the RTC deflection yoke over the conventional circular deflection yoke.

First of all, when the horizontal and vertical deflection coils move to the neck side, the magnetic flux density per unit area is increased, and the deflecting force for deflecting electron beams gets stronger, and the deflection sensitivity is greatly improved.

The above is an extra effect for the deflection sensitivity besides the enhanced deflection density obtained from the change of configuration of the deflection coil, namely from a circular shape to a rectangular shape.

In addition, the ferrite core of the present invention, unlike the conventional circular deflection yoke, translates closer to the neck side by 1–10 mm, so the cross-sectional configuration of the ferrite core gets smaller and the difference between the neck side area and the screen side area is reduced. In its result, the cost of materials for ferrite cores can be reduced.

When the RTC deflection yoke is compared with the conventional RAC deflection yoke, it is found that the horizontal and vertical deflection coils and the holder for both are all in a substantially rectangular shape, but the sectional configuration on the screen side of the ferrite core in the RTC deflection yoke is a circular shape while that of the conventional RAC deflection yoke is a rectangular shape.

In addition, the RTC deflection yoke and the RAC deflection yoke manifest similar deflection sensitivities. The underlying principle of this is provided below.

The horizontal deflection sensitivity (Ph) can be defined as follows:

$$Ph = Lh \times Ih^2 \text{peak-peak}$$

Here, Ph is the deflection sensitivity of the horizontal deflection coil; Lh is an inductance of the horizontal deflection coil; Ihpeak-peak is a peak value-peak value of the current traveling in the horizontal deflection coil. If the configuration of the ferrite core changes from the rectangular shape to the circular shape, the Ih value is increased but the inductance value (Lh) of the horizontal deflection coil is decreased. Hence, this offsets the difference of the horizontal deflection sensitivities for both deflection yokes.

The RTC deflection yoke according to the present invention is more advantageous than the conventional RAC deflection yoke in that it can improve convergence and distortion errors due to the size deviation on the inner surface of the rectangular ferrite core 44 and reduce the cost of materials for the ferrite core.

Moreover, the ferrite core of the present invention, unlike the known rectangular ferrite core illustrated in FIG. 8, is in a circular shape, so the inner surface diameter in the horizontal and vertical directions is uniform. This makes it easier to produce a fine-pitch ferrite core having a very high precision and the size deviation of the inner surface below 0.02 mm through the abrasive blasting process. Further, the yield of such ferrite cores becomes about three times greater than that of the rectangular ferrite core in the related art.

Figure 14A:
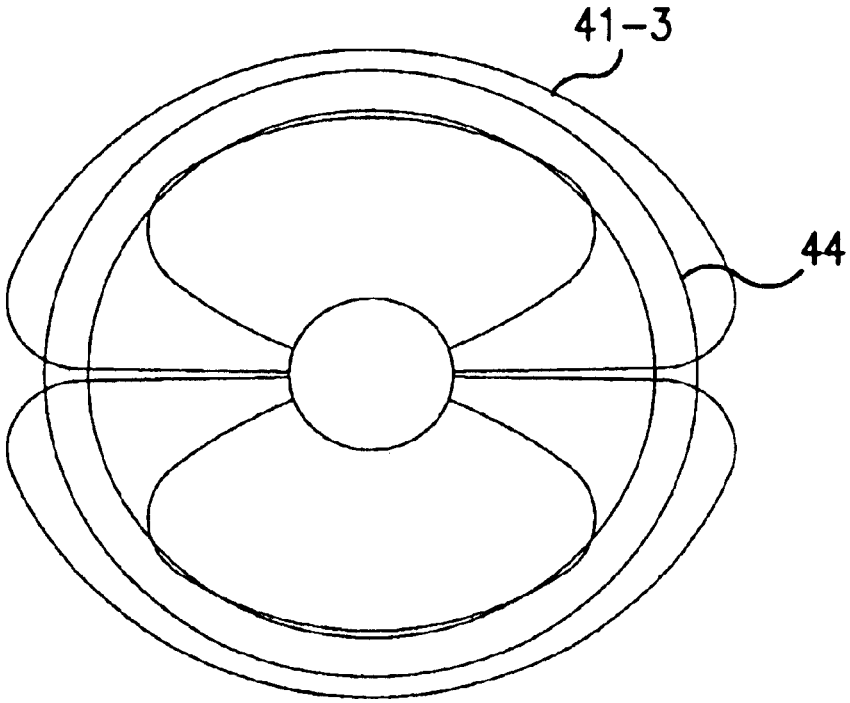
FIGS. 14*a* through 14*c* illustrate an arrangement of a screen side flange end section of a horizontal deflection coil and a screen side end portion of a ferrite core in a conventional circular deflection yoke, a conventional RAC deflection yoke, and a RTC deflection yoke according to the present invention, respectively.
Figure 14B:
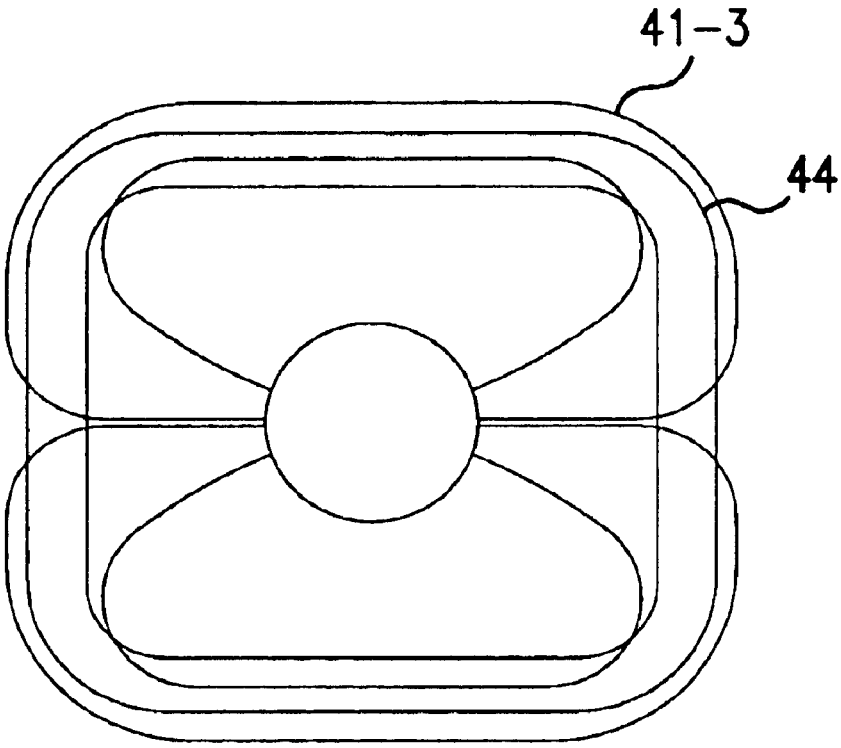
FIG.14b (RELATED ART)

FIGS. 14*a* and 14*b* depict a layout of the flange section on the screen side in the horizontal deflection coil and the end section on the screen side of the ferrite core in the conventional circular and RAC deflection yokes, respectively.

If the horizontal deflection coil is in a circular shape, the shape of ferrite core 44 is also circular. Similarly, if the horizontal deflection coil has a rectangular shape, the ferrite core 44 has the rectangular shape also. Because the flange section 41-3 on the screen side of the horizontal deflection coil is spaced out of the screen side end of the ferrite core 44, the loss in the magnetic force produced by the current flowing in the horizontal and vertical deflection coils is reduced, and the ferrite core for improving the deflection efficiency cannot have any influence thereon. Accordingly, leakage magnetic field intensities increase.

As shown in FIG. 13, the RTC deflection yoke according to the present invention is particularly structured so as to make the difference between the maximum gap and the minimum gap described above is greatest at the end section of the screen side of the ferrite core 44.

Figure 14C:
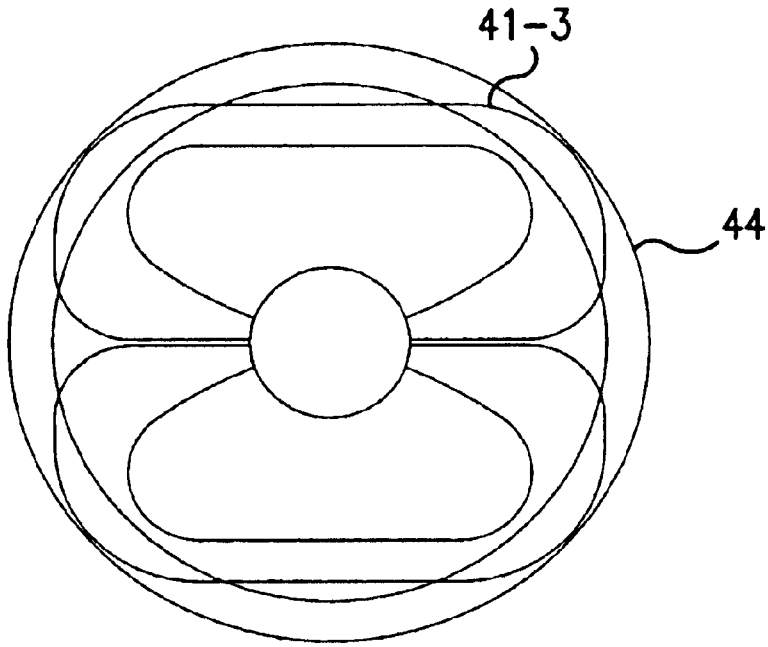

As well depicted in FIG. 14*c*, the maximum gap exists on the basis of the plane perpendicular to the horizontal deflection coil 41 and the tube axis at the end section on the screen side of the ferrite core 44, and the flange section 41-3 on the screen side of the horizontal deflection coil is formed on an inward side the ferrite core 44.

Figure 15:
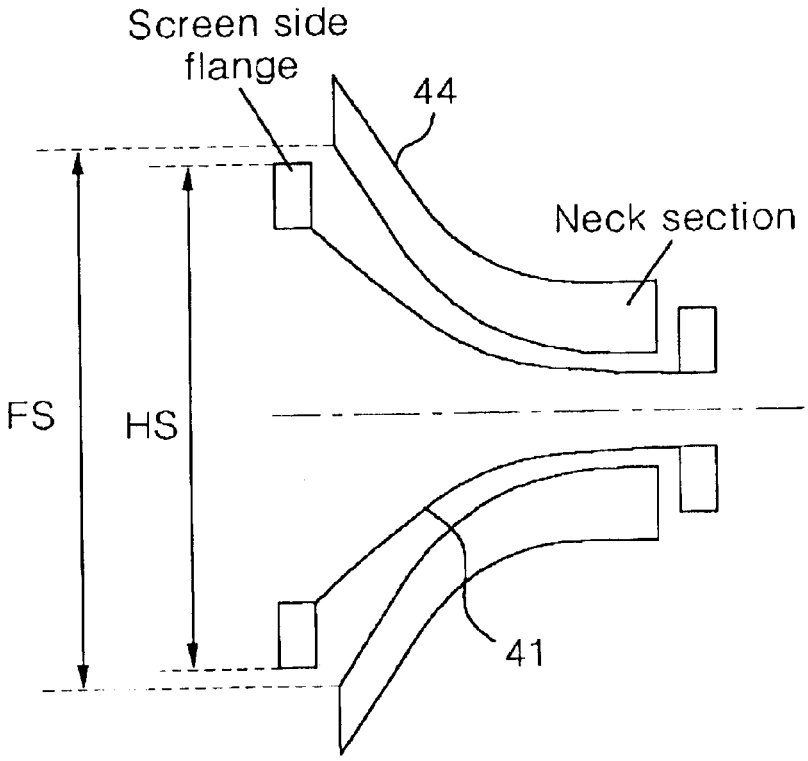
FIG. 15 is a cross-sectional view of the RTC deflection yoke according to the present invention.
Figure 16:
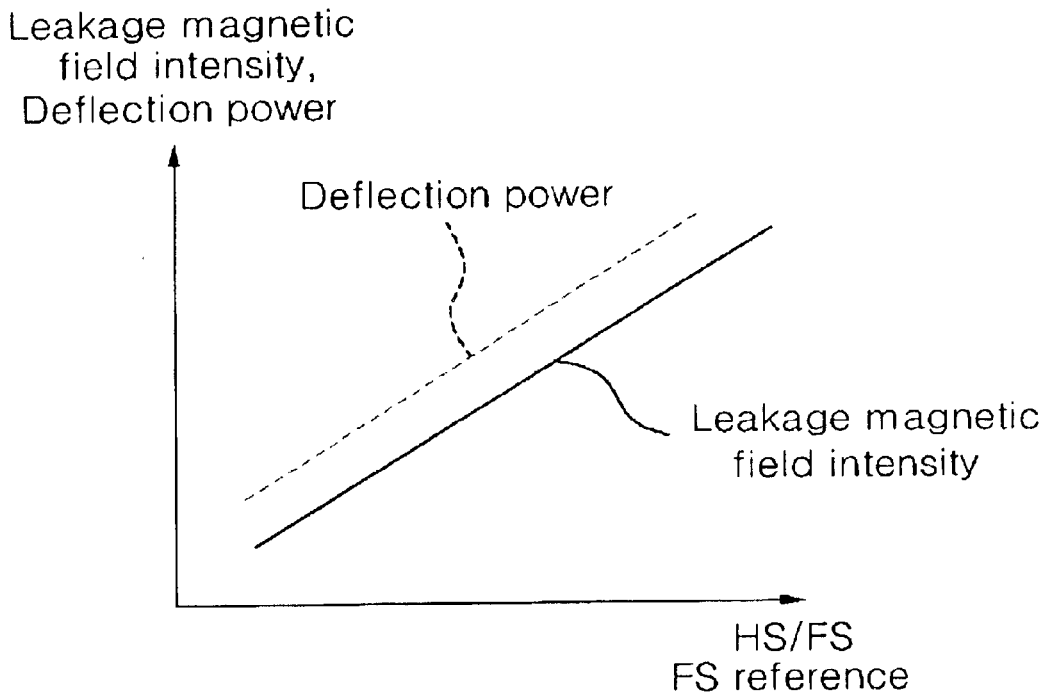
FIG. 16 is a view explaining a relation between a leakage magnetic field/deflection power and HS/FS.

FIG. 15 is a cross-sectional view of the RTC deflection yoke according to the present invention. The outer surface diameter (HS) of the flange section on the screen side of the horizontal deflection coil ranges 80% to 110% of the inner surface diameter (FS) on the screen side of the ferrite core. As its result, the leakage magnetic field intensity and the deflection power were reduced.

More specifically speaking, as FIGS. 14*a* and 14*b* represent, the outer surface diameter (HS) of the flange section on the screen side of the horizontal deflection coil is shorter than the outer or inner surface diameter (FS) on the screen side of the ferrite core while the conventional flange section on the screen side of the horizontal deflection coil used to be outside of the ferrite core. In short, the flange section is located inside or outside end section of the ferrite core for thereby reducing the leakage magnetic field intensity and the deflection power more effectively.

Table 2 (provided below) shows the ratio (in percentage) of the outer surface diameter (HS) of the flange section on the screen side end section of the horizontal deflection coil to the inner surface diameter (FS) on the screen side of the ferrite core in different models, such as, the conventional circular and RAC deflection yokes and the RTC deflection yoke of the present invention.

TABLE 2

| Model | Outer surface diameter (HS) of the flange section on the screen side of the horizontal deflection coil | Inner surface diameter (FS) on the screen side of the ferrite core | HS/FS (%) |
|---|---|---|---|
| Circular DY (from the related art) | 140 mm | 110.21 mm | 127.0% |
| RAC DY (from the related art) | 100 mm | 83 mm | 120.5% |
| RTC DY (from the present invention) | 100 mm | 105.36 mm | 94.9% |

As shown in Table 2, the ratio (in percentage) of the outer surface diameter (HS) of the flange section on the screen side of the horizontal deflection coil to the inner surface diameter (FS) on the screen side end section of the ferrite core in the RTC deflection yoke according to the present invention, HS/FS, is below 100%. But HS/FS of the conventional deflection yoke is greater than 120%. In short, since the ratio of HS/FS of the horizontal deflection coil is small, the deflection yoke according to the present invention is capable of diminishing the leakage magnetic field intensity and the deflection power more effectively.

Preferably, the outer surface diameter (HS) of the flange section on the screen side of the horizontal deflection coil mounted inside of the ferrite core 44 ranges from 80% to 110% of the inner surface diameter (FS) of the end section on the screen side of the ferrite core.

More preferably, the outer surface diameter (HS) of the flange section on the screen side of the horizontal deflection coil mounted inside of the ferrite core 44 ranges from 80% to 100% of the inner surface diameter (FS) of the end section on the screen side of the ferrite core.

Meanwhile, the flange section 41-3 on the screen side of the horizontal deflection coil 41 has little influence on deflecting electron beams, but it can deteriorate the deflection sensitivity in the horizontal direction by increasing the inductance value of the horizontal deflection coil 41 too much. Therefore, if the flange section 41-3 on the screen side of the horizontal deflection coil can be made as small as possible, reducing invalid magnetic fields, the deflection sensitivity can be greatly improved.

Figure 17:
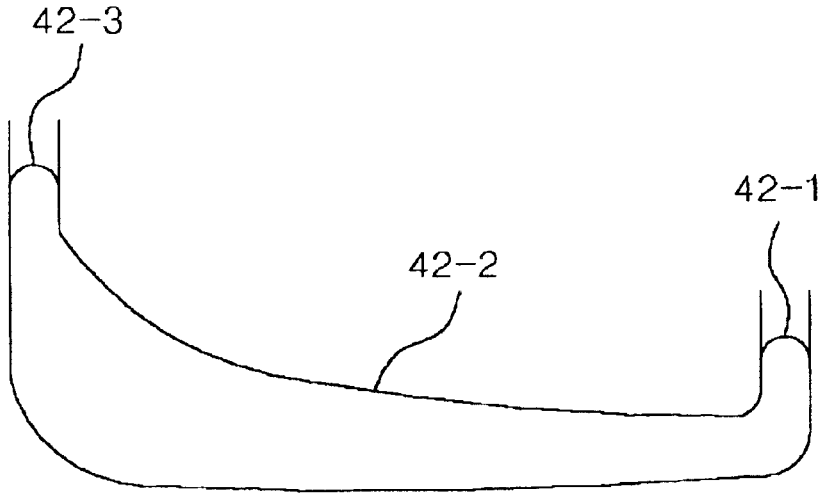
FIG. 17 is a view illustrating a structure of a general vertical deflection coil.

As illustrated in FIG. 17, the vertical deflection coil 42 consists of a flange section 42-1 on the neck side, a middle section 42-2, and a flange section on the screen side 42-3. The middle section 42-2 located to be parallel to the tube axis of the cathode-ray tube substantially deflects electron beams in the vertical direction. The flange section 42-1 on the neck side rarely deflects electron beams but increases the inductance value of the deflection coil. Primarily, the flange section 42-3 on the screen side and the flange section 42-1 on the neck side has the same function.

Figure 18:
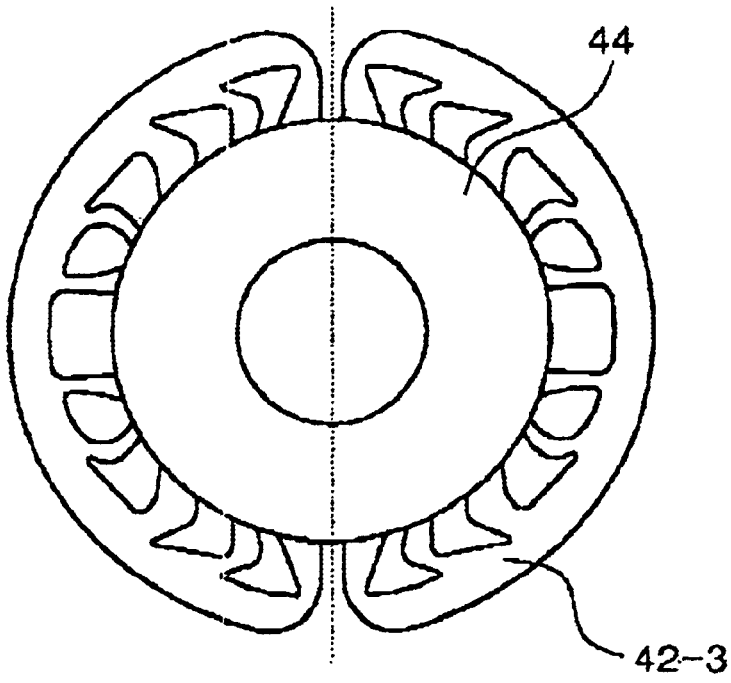
FIG. 18 (Related Art)
FIG. 18 diagrammatically represents a layout of the flange section on the screen side and the end section on the screen side of the ferrite core of the conventional circular deflection yoke.

FIG. 18 diagrammatically represents a layout of the flange section on the screen side and the end section on the screen side of the ferrite core of the conventional circular deflection yoke.

Here, the vertical deflection coil 42 as well as the ferrite core 44 is in a circular shape. Also, the flange section 42-3 on the screen side of the vertical deflection coil surrounds the entire end section on the screen side of the circular ferrite core 44, and most of the flange section 42-3 on the screen side of the vertical deflection coil is located outside the ferrite core 44. This consequently increases the vertical inductance to a great extent, and the deflection sensitivity in the vertical direction gets worse.

Figure 19:
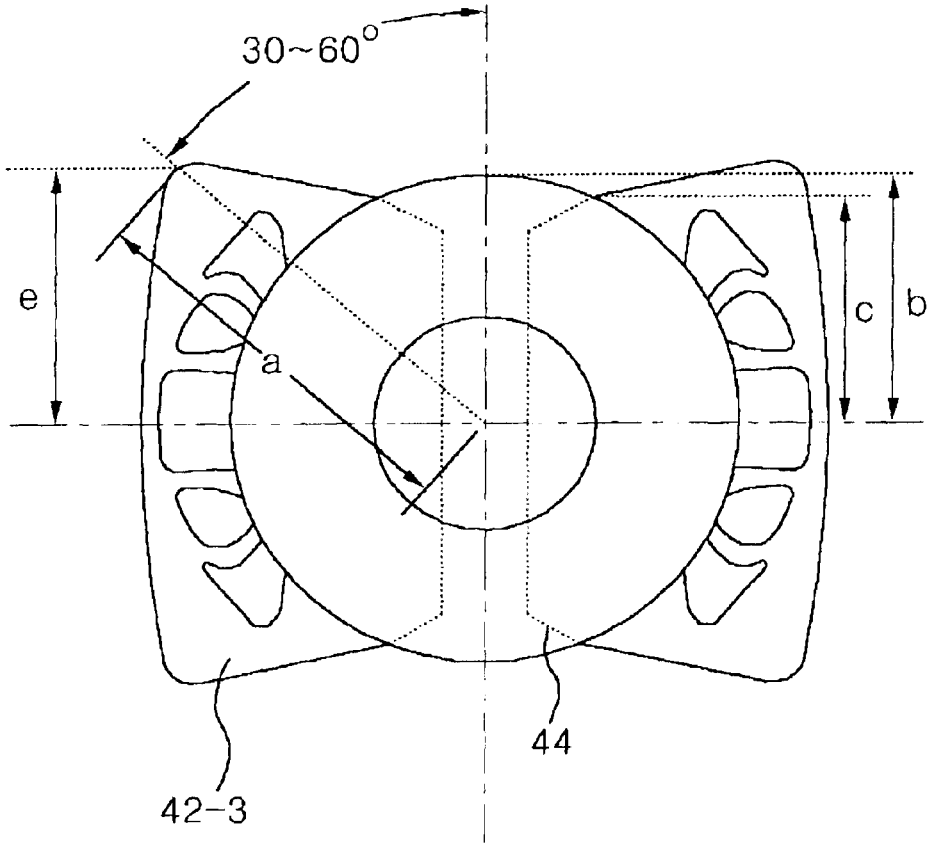
FIG. 19 diagrammatically represents an arrangement of the flange section on the screen side and the end section on the screen side of the ferrite core of the RTC deflection yoke according to the present invention.

As depicted in FIG. 19, a pair of vertical deflection coils 42 is arranged on both sides of the vertical axis.

The distance (c) from the horizontal axis to a point closest to the vertical axis in which the flange section 42-3 on the screen side of the vertical deflection coil and the outer surface of end section on the screen side of the ferrite core 44 meet is shorter than the radius (b) of the end section on the screen side of the ferrite core 44.

As shown in FIG. 19, the ratio of a radius (b) of the end section on the screen side of the ferrite core to a length of a straight line (e) connecting a horizontal axis to a vertical axis of the flange section 42-3 on the screen side of the vertical deflection coil in a region at an angle of 30° to 60° from the vertical axis, i.e., b/e, ranges from 0.7 to 1.1.

Figure 20:
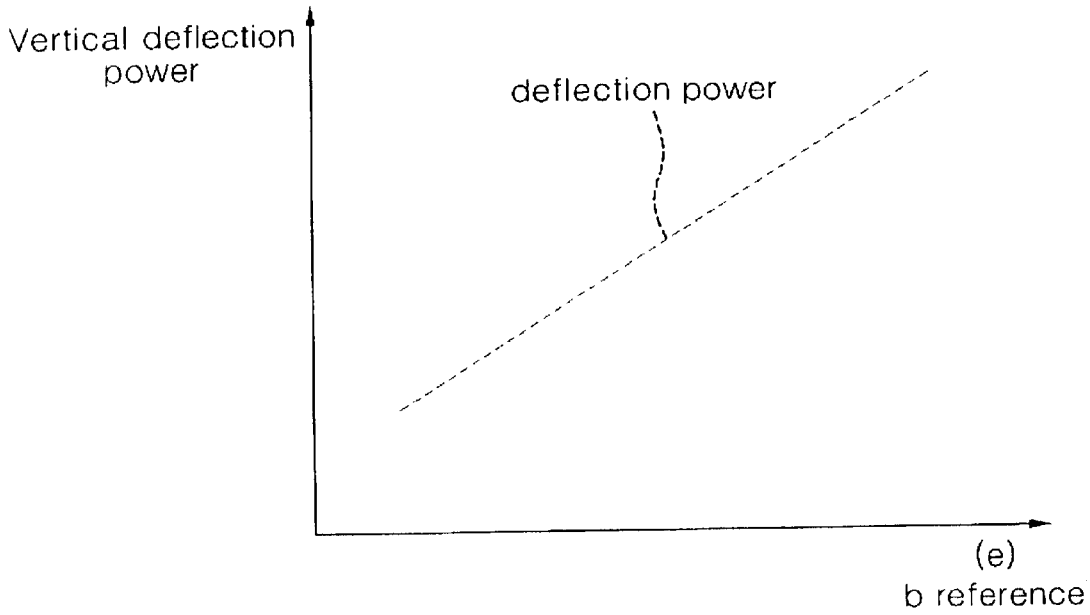
FIG. 20 is a graph explaining a relation between a deflection force and a length of straight line (e) along a vertical axis of the screen side flange section of the vertical deflection coil from a horizontal axis in a region at an angle of 30° to 60° from the vertical axis.

FIG. 20 is a graph for explaining a relation between a deflection force and a length of straight line (e) along a vertical axis of the screen side flange section 42-3 of the vertical deflection coil from a horizontal axis in a region at an angle of ±(30°~60°) from the vertical axis. As manifested in the drawing, the deflection power is proportional to the e value.

Figure 21:
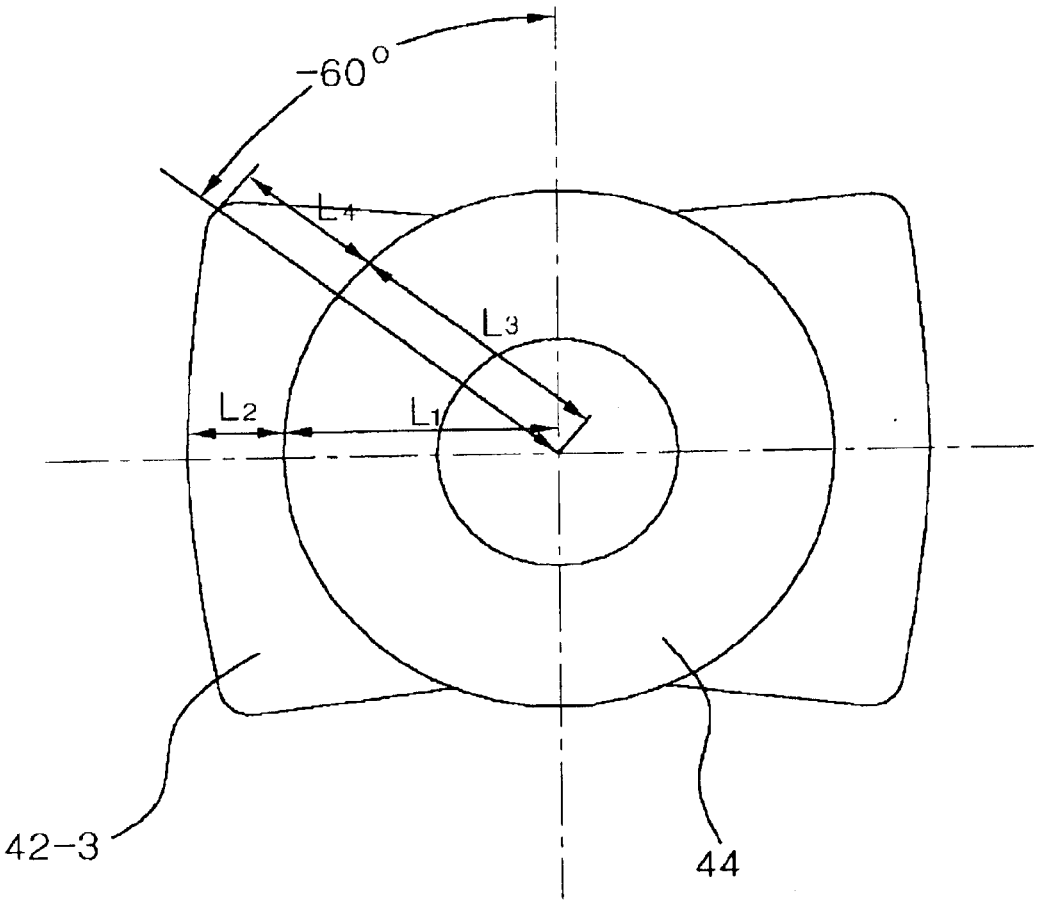
FIG. 21 is a front view of the vertical deflection coil and the ferrite core of the RTC deflection yoke according to the present invention.

FIG. 21 is a front view of the vertical deflection coil 42 and the ferrite core 44 of the RTC deflection yoke according to the present invention. Suppose that the radiuses of the ferrite cores 44 using the horizontal axis as a coordinate axis are L1 and L3, and the distance from the outer circumference of the ferrite core 44 to the farthest parts of the flange section 42-3 on the screen side of the vertical deflection coil are L2 and L4. Then, the smallest L2/L1 on the basis of the horizontal axis was 0.05, and the biggest L4/L3 in the region at an angle of −60° from the vertical axis was 0.13. In other words, in the region at an angle of 60° to 90° from the vertical axis (in either direction) 0° to 30° from the horizontal axis (in either direction), the ratio of the distance L2, L4 from the outer circumference of the ferrite core to the farthest point of the flange section on the screen side of the vertical deflection coil to the radius L1, L3 of the ferrite core 44, i.e., L2/L1 or L4/L3, ranges from 0.05 to 0.13.

In conclusion, the RTC deflection yoke according to the present invention has advantages as follows First, because the inner surface of the RTC type ferrite core is a circular shape, the size deviation in connection with the inner surface of the ferrite core is reduced by more than ½, and it becomes easy to manufacture a ferrite core with a high precision through the abrasive blasting process on the inner surface of the ferrite core. Further, the cost of materials for the ferrite core can be reduced down to ⅓, and the convergence and distortion errors often found in the conventional deflection yoke are greatly improved for thereby realizing a fine-pitch deflection yoke;

Second, the deflection coil according to the present invention, unlike the conventional circular deflection yoke, has a rectangular shape, and the deflection yoke can be shifted closer to the neck side by 1–10 mm. As the result thereof, the deflection sensitivity is enhanced up to 20–30% of the deflection sensitivity for the circular deflection yoke;

Third, the small sized flange section on the screen side of the horizontal and vertical deflection coils mounted in the RTC deflection yoke according to the present invention is effective for reducing the leakage magnetic field intensity and the deflection power; and Fourth, unlike the conventional RAC core, because the ferrite core according to the present invention has a large air layer between the horizontal and vertical deflection coils, the present invention can be advantageously used for improving a heating effect due to the enhanced convection effect.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A color cathode-ray tube comprising a panel having a fluorescent screen, Red, Green, and Blue fluorescent substances being applied to an inner surface of the panel, a funnel coupled to a rear surface of the panel for maintaining an inside thereof in a vacuum state, an electron gun installed inside of a pipe-shaped neck section disposed at a rear side of the funnel for emitting electron beams, and a deflection yoke for horizontally or vertically deflecting the electron beams, wherein the deflection yoke comprises:

a horizontal deflection coil and a vertical deflection coil for deflecting electron beams emitted from the electron gun in the horizontal or vertical direction;

a ferrite core for enhancing a magnetic efficiency by minimizing a loss in a magnetic force generated by the horizontal and vertical deflection coils, wherein a sectional configuration on a screen side of the horizontal or vertical deflection coils has a substantially rectangular shape, and a shape of the ferrite core is either circular or elliptical, and an outer surface dimension size (HS) of a flange section of the horizontal defection coil on the screen side of the horizontal deflection coil mounted inside of the ferrite core ranges from 80% of an inner face actual size (FS) of an end section on the screen side of the ferrite core at the narrowest portion of said flange section to no more than 110% of an inner face actual size (FS) of an end section on the screen side of the ferrite core at the widest portion of said flange section; and a holder for fixing the horizontal and vertical deflection coils and the ferrite core at predetermined positions and insulating the horizontal and vertical deflection coils.

2. The color cathode-ray tube according to claim 1, wherein a sectional configuration on a screen side of the horizontal and vertical deflection coils is in a substantially rectangular shape.

3. The color cathode-ray tube according to claim 1, wherein a sectional configuration on a screen side of the holder is in a substantially rectangular shape.

4. A color cathode-ray tube comprising a panel having a fluorescent screen, Red, Green, and Blue fluorescent substances being applied to an inner surface of the panel, a funnel coupled to a rear surface of the panel for maintaining an inside thereof in a vacuum state, an electron gun installed inside of a pipe-shaped neck section disposed at a rear side of the funnel for emitting electron beams, and a deflection yoke for horizontally or vertically deflecting the electron beams, wherein the deflection yoke comprises:

a horizontal deflection coil and a vertical deflection coil for deflecting electron beams emitted from the electron gun in the horizontal or vertical direction;

a ferrite core for enhancing a magnetic efficiency by minimizing a loss in a magnetic force generated by the horizontal and vertical deflection coils, wherein a sectional configuration on a screen side of the horizontal or vertical deflection coils has a substantially rectangular shape, and a shape of the ferrite core is either circular or elliptical, and the outer surface perimeter of a flange section on the screen side of the horizontal deflection coil mounted inside of the ferrite core does not extend beyond the outer surface perimeter of an end section on the screen side of the ferrite core; and a holder for fixing the horizontal and vertical deflection coils and the ferrite core at predetermined positions and insulating the horizontal and vertical deflection coils.

5. The color cathode-ray tube according to claim 4, wherein a sectional configuration on a screen side of the horizontal and vertical deflection coils is in a substantially rectangular shape.

6. The color cathode-ray tube according to claim 4, wherein a sectional configuration on a screen side of the holder is in a substantially rectangular shape.

7. A color cathode-ray tube comprising a panel having a fluorescent screen, Red, Green, and Blue fluorescent substances being applied to an inner surface of the panel, a funnel coupled to a rear surface of the panel for maintaining an inside thereof in a vacuum state, an electron gun installed inside of a pipe-shaped neck section disposed at a rear side of the funnel for emitting electron beams, and a deflection yoke for horizontally or vertically deflecting the electron beams, wherein the deflection yoke comprises:

a horizontal deflection coil and a vertical deflection coil for deflecting electron beams emitted from the electron gun in the horizontal or vertical direction;

a ferrite core for enhancing a magnetic efficiency by minimizing a loss in a magnetic force generated by the horizontal and vertical deflection coils, wherein a sectional configuration on a screen side of the horizontal or vertical deflection coils has a substantially rectangular shape, and that of the ferrite core is either circular or elliptical, and the outer surface perimeter size of the flange section on the screen side of the horizontal deflection coil mounted inside of the ferrite core is within the inner surface boundary of an end section on the screen side of the ferrite core; and a holder for fixing the horizontal and vertical deflection coils and the ferrite core at predetermined positions and insulating the horizontal and vertical deflection coils.

8. The color cathode-ray tube according to claim 7, wherein a sectional configuration on a screen side of the horizontal and vertical deflection coils is in a substantially rectangular shape.

9. The color cathode-ray tube according to claim 7, wherein a sectional configuration on a screen side of the holder is in a substantially rectangular shape.

10. The color cathode-ray tube according to claim 7, wherein a diameter of the flange section on the screen side of the horizontal deflection coil mounted inside of the ferrite core ranges from 80% to 100% of the diameter of the end section on the screen side of the ferrite core.

11. A color cathode-ray tube comprising a panel having a fluorescent screen, Red, Green, and Blue fluorescent substances being applied to an inner surface of the panel, a funnel coupled to a rear surface of the panel for maintaining an inside thereof in a vacuum state, an electron gun installed inside of a pipe-shaped neck section disposed at a rear side of the funnel for emitting electron beams, and a deflection yoke for horizontally or vertically deflecting the electron beams, wherein the deflection yoke comprises:

a horizontal deflection coil and a vertical deflection coil for deflecting electron beams emitted from the electron gun in the horizontal or vertical direction;

a ferrite core for enhancing a magnetic efficiency by minimizing a loss in a magnetic force generated by the horizontal and vertical deflection coils, wherein a sectional configuration on a screen side of the horizontal or vertical deflection coils has a substantially rectangular shape, and that of the ferrite core is either circular or elliptical, and a pair of the vertical deflection coils is arranged on both sides of a vertical axis, and a length of a straight line (c) connecting a horizontal axis to a point closest to the vertical axis in which an flange section on the screen side of the vertical deflection coil and the outer surface of the end section on the screen side of the ferrite core meet is shorter than a radius (b) of the end section on the screen side of the ferrite core; and a holder for fixing the horizontal and vertical deflection coils and the ferrite core at predetermined positions and insulating the horizontal and vertical deflection coils.

12. The color cathode-ray tube according to claim 11, wherein a sectional configuration on a screen side of the horizontal and vertical deflection coils is in a substantially rectangular shape.

13. The color cathode-ray tube according to claim 11, wherein a sectional configuration on a screen side of the holder is in a substantially rectangular shape.

14. A color cathode-ray tube comprising a panel having a fluorescent screen, Red, Green, and Blue fluorescent substances being applied to an inner surface of the panel, a funnel coupled to a rear surface of the panel for maintaining an inside thereof in a vacuum state, an electron gun installed inside of a pipe-shaped neck section disposed at a rear side of the funnel for emitting electron beams, and a deflection yoke for horizontally or vertically deflecting the electron beams, wherein the deflection yoke comprises:

a horizontal deflection coil and a vertical deflection coil for deflecting electron beams emitted from the electron gun in the horizontal or vertical direction;

a ferrite core for enhancing a magnetic efficiency by minimizing a loss in a magnetic force generated by the horizontal and vertical deflection coils, wherein a sectional configuration on a screen side of the horizontal or vertical deflection coils has a substantially rectangular shape, and that of the ferrite core is either circular or elliptical, and a pair of the vertical deflection coils is arranged on both sides of a vertical axis, and a ratio of a radius (b) of the end section on the screen side of the ferrite core to a length of a straight line (e) connecting a horizontal axis to a vertical axis of a flange section on the screen side of the vertical deflection coil in a region at an angle of 30° to 60° in either direction with respect to the vertical axis, namely b/e, ranges from 0.7 to 1.1; and a holder for fixing the horizontal and vertical deflection coils and the ferrite core at predetermined positions and insulating the horizontal and vertical deflection coils.

15. The color cathode-ray tube according to claim 14, wherein a sectional configuration on a screen side of the horizontal and vertical deflection coils is in a substantially rectangular shape.

16. The color cathode-ray tube according to claim 14, wherein a sectional configuration on a screen side of the holder is in a substantially rectangular shape.

17. A color cathode-ray tube comprising a panel having a fluorescent screen, Red, Green, and Blue fluorescent substances being applied to an inner surface of the panel, a funnel coupled to a rear surface of the panel for maintaining an inside thereof in a vacuum state, an electron gun installed inside of a pipe-shaped neck section disposed at a rear side of the funnel for emitting electron beams, and a deflection yoke for horizontally or vertically deflecting the electron beams, wherein the deflection yoke comprises:

a horizontal deflection coil and a vertical deflection coil for deflecting electron beams emitted from the electron gun in the horizontal or vertical direction;

a ferrite core for enhancing a magnetic efficiency by minimizing a loss in a magnetic force generated by the horizontal and vertical deflection coils, wherein a sectional configuration on a screen side of the horizontal or vertical deflection coils has a substantially rectangular shape, and that of the ferrite core is either circular or elliptical, and a pair of the vertical deflection coils is arranged on both sides of a vertical axis, and a ratio of a distance L2 from the outer circumference of the ferrite core to the farthest point of the flange section on the screen side of the vertical deflection coil to a radius L1 of the ferrite core in a region at an angle of 60° to 90° in either direction with respect to the vertical axis, namely L2/L1, ranges from 0.05 to 0.13; and a holder for fixing the horizontal and vertical deflection coils and the ferrite core at predetermined positions and insulating the horizontal and vertical deflection coils.

18. The color cathode-ray tube according to claim 17, wherein a sectional configuration on a screen side of the horizontal and vertical deflection coils is in a substantially rectangular shape.

19. The color cathode-ray tube according to claim 17, wherein a sectional configuration on a screen side of the holder is in a substantially rectangular shape.

* * * * *